US010950184B2

(12) United States Patent
Bae

(10) Patent No.: US 10,950,184 B2
(45) Date of Patent: Mar. 16, 2021

(54) DISPLAY DEVICE

(71) Applicant: Samsung Display Co., Ltd., Yongin-si (KR)

(72) Inventor: Min Seok Bae, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/523,600

(22) Filed: Jul. 26, 2019

(65) Prior Publication Data

US 2020/0051509 A1 Feb. 13, 2020

(30) Foreign Application Priority Data

Aug. 7, 2018 (KR) ..... 10-2018-0091734

(51) Int. Cl.
*G09G 3/3291* (2016.01)
*G09G 3/20* (2006.01)

(52) U.S. Cl.
CPC ..... *G09G 3/3291* (2013.01); *G09G 3/2007* (2013.01); *G09G 2300/043* (2013.01)

(58) Field of Classification Search
CPC ..... G09G 3/3291; G09G 3/2007; G09G 2300/043; G09G 2320/043; G09G 2320/0295; G09G 2340/0435; G09G 3/3266; G09G 2300/0819; G09G 2300/0842; G09G 2300/0861; G09G 3/3233
See application file for complete search history.

(56) References Cited

U.S. PATENT DOCUMENTS

| | | | | |
|---|---|---|---|---|
| 9,520,082 | B2 * | 12/2016 | Choi | G09G 3/3233 |
| 9,984,623 | B2 | 5/2018 | An et al. | |
| 10,004,124 | B1 * | 6/2018 | Ko | G09G 3/3233 |
| 10,223,972 | B1 * | 3/2019 | Kuang | G09G 3/3258 |
| 2016/0124491 | A1 * | 5/2016 | An | G09G 3/3233 713/323 |
| 2017/0249882 | A1 | 8/2017 | Lee | |
| 2018/0075808 | A1 * | 3/2018 | Yamashita | G09G 3/3266 |
| 2018/0151656 | A1 * | 5/2018 | Choo | G09G 3/3233 |
| 2018/0350286 | A1 * | 12/2018 | Lee | G09G 3/3233 |
| 2018/0357964 | A1 * | 12/2018 | Shin | H01L 27/3262 |

FOREIGN PATENT DOCUMENTS

| | | | |
|---|---|---|---|
| KR | 10-2017-0036934 | A | 4/2017 |
| KR | 10-2017-0102130 | A | 9/2017 |

* cited by examiner

*Primary Examiner* — Ibrahim A Khan
(74) *Attorney, Agent, or Firm* — Lewis Roca Rothgerber Christie LLP

(57) ABSTRACT

A display device includes pixels each having: a first transistor having a first electrode, second electrode, and gate electrode; a second transistor having a first electrode connected to a data line, a second electrode connected to the first electrode of the first transistor, and a gate electrode connected to a first scan line; a third transistor having a first electrode connected to the second electrode of the first transistor, a second electrode connected to the gate electrode of the first transistor, and a gate electrode connected to the first scan line; and a fourth transistor having a first electrode connected to the gate electrode of the first transistor, a second electrode connected to an initialization voltage line, and a gate electrode connected to a second scan line. A first scan signal is applied in each frame period of a first driving mode and a second driving mode.

16 Claims, 7 Drawing Sheets

DISPLAY DEVICE

CROSS-REFERENCE TO RELATED APPLICATION

The present application claims priority to and the benefit of Korean patent application 10-2018-0091734 filed on Aug. 7, 2018 in the Korean Intellectual Property Office, the entire disclosure of which is incorporated herein by reference.

BACKGROUND

1. Field

The present disclosure generally relates to a display device.

2. Description of the Related Art

With the development of information technologies, the importance of a display device, which is a connection medium between a user and information, has increased. Accordingly, display devices such as a liquid crystal display device, an organic light emitting display device, and a microLED display device are increasingly used.

An organic light emitting display device displays an image using organic light emitting diodes that generate light by recombination of electrons and holes. The organic light emitting display device has a high response speed and is driven with low power consumption.

Each pixel of the organic light emitting display device may include a driving transistor for controlling an amount of driving current to be supplied to the organic light emitting diode. The driving transistors of the respective pixels may have different threshold voltages due to a process variation, degradation, etc. Therefore, it is desirable to detect a threshold voltage of the driving transistor and compensate for the threshold voltage.

SUMMARY

Embodiments provide a display device capable of changing a compensation method of a driving transistor depending on an image frequency.

According to an aspect of the present disclosure, there is provided a display device including a plurality of pixels, wherein each pixel includes: a first transistor including a first electrode, a second electrode, and a gate electrode; a second transistor including a first electrode connected to a data line, a second electrode connected to the first electrode of the first transistor, and a gate electrode connected to a first scan line; a third transistor including a first electrode connected to the second electrode of the first transistor, a second electrode connected to the gate electrode of the first transistor, and a gate electrode connected to the first scan line; and a fourth transistor including a first electrode connected to the gate electrode of the first transistor, a second electrode connected to an initialization voltage line, and a gate electrode connected to a second scan line, wherein a first scan signal having a turn-on level is applied at least once to the first scan line in each first image frame period of a first driving mode including a plurality of first image frames, and wherein the first scan signal having a turn-off level is maintained in the first scan line in each second image frame period of a second driving mode including a plurality of second image frames.

In the first image frame period, an initialization voltage may be maintained in the initialization voltage line, and a data voltage may be applied to the data line. The data voltage may be applied to the initialization voltage line during at least a portion of the second image frame period.

In a sensing mode, a reference voltage may be applied to the data line, a second scan signal having the turn-on level may be applied to the second scan line during a first period, the first scan signal having the turn-on level may be applied to the first scan line during a second period after the first period, and the second scan signal having the turn-on level may be applied to the second scan line during a third period after the second period.

The display device may further include: an initialization voltage supply unit configured to supply the initialization voltage; and a voltage sensing unit. In the sensing mode, the initialization voltage line may be connected to the initialization voltage supply unit during at least a portion of the first period, and be connected to the voltage sensing unit during at least a portion of the third period.

The voltage sensing unit may include at least one analog-to-digital converter. The analog-to-digital converter may convert a voltage input through the initialization voltage line during at least a portion of the third period into sensing information.

The display device may further include: a timing controller configured to provide a grayscale value; and a data driver configured to generate the data voltage corresponding to the grayscale value and supply the data voltage to the data line. The voltage sensing unit may provide the sensing information to the timing controller. In the second driving mode, the timing controller may provide the grayscale value, based on the sensing information.

The pixel may further include: a fifth transistor including a first electrode connected to a first power voltage line, a second electrode connected to the first electrode of the first transistor, and a gate electrode connected to an emission line; a sixth transistor including a first electrode connected to the second electrode of the first transistor and a gate electrode connected to the emission line; a seventh transistor including a first electrode connected to the second electrode of the sixth transistor, the other electrode connected to the initialization voltage line, and a gate electrode connected to a third scan line; a storage capacitor including a first electrode connected to the gate electrode of the first transistor and a second electrode connected to the first power voltage line; and an organic light emitting diode including an anode electrode connected to the one electrode of the seventh transistor and a cathode electrode connected to a second power voltage line.

In the sensing mode, a third scan signal having the turn-off level may be maintained in the third scan line, and an emission signal having the turn-off level may be maintained in the emission line.

In the second driving mode, the third scan signal having the turn-off level may be maintained in the third scan line.

The initialization voltage may be applied to the initialization voltage line during at least another portion of the second image frame period.

During the second image frame, horizontal periods when the turn-on level is applied to the second scan line and the turn-on level is applied to the third scan line may be different from each other.

During the second image frame, horizontal periods when the turn-on level is applied to the second scan line and the turn-on level is applied to the third scan line may be the same.

The initialization voltage line and the data line may extend in the same direction.

A number of data lines connected to the plurality of pixels and a number of initialization voltage lines connected to the plurality of pixels may be equal to each other.

A first image frequency at which the plurality of first image frames are changed in the first driving mode may be lower than a second image frequency at which the plurality of second image frames are changed in the second driving mode.

The first image frequency may be 60 Hz or less, and the second image frequency may exceed 60 Hz.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
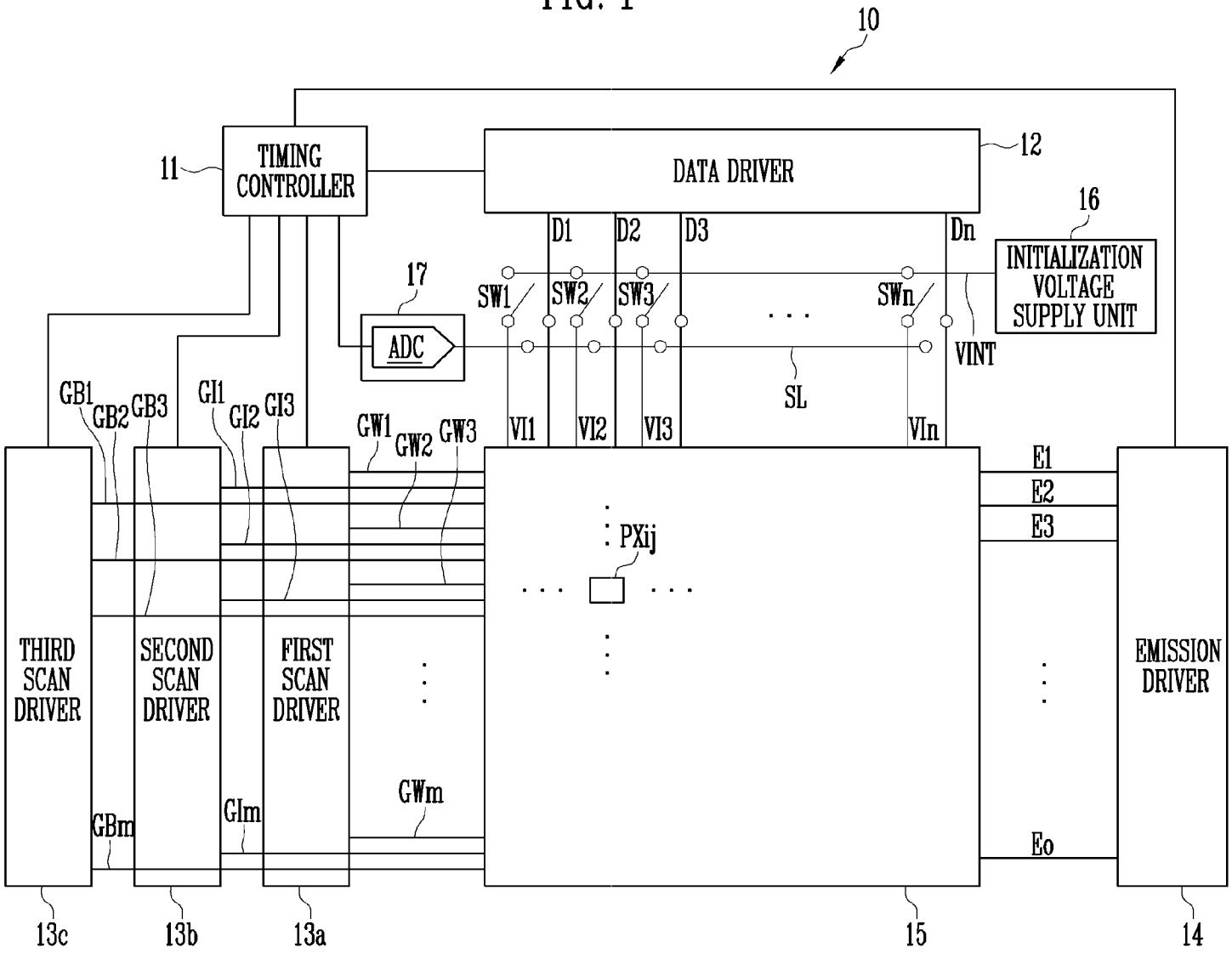
FIG. 1 is a diagram illustrating a display device according to an embodiment of the present disclosure.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

In addition, the size and thickness of each component illustrated in the drawings are arbitrarily shown for better understanding and ease of description, but the present disclosure is not limited thereto. Thicknesses of several portions and regions are exaggerated for clear expressions.

FIG. 1 is a diagram illustrating a display device according to an embodiment of the present disclosure.

Referring to FIG. 1, the display device 10 may include a timing controller 11, a data driver 12, a first scan driver 13*a*, a second scan driver 13*b*, a third scan driver 13*c*, an emission driver 14, a display unit 15, an initialization voltage supply unit 16, and a voltage sensing unit 17.

In various embodiments, the display device 10 may be driven in a first driving mode, a sensing mode, or a second driving mode.

The first driving mode may include a plurality of first image frames. In addition, the second driving mode may include a plurality of second image frames. The sensing mode may not include image frames. A first image frame period may be a period for supplying data corresponding to the first image frame to the display device 10. Similarly, a second image frame period may be a period for supplying data corresponding to the second image frame to the display device 10.

A first image frequency at which the plurality of first image frames are changed (e.g., a refresh rate) in the first driving mode may be lower than a second image frequency at which the plurality of second image frames are changed in the second driving mode. For example, the first image frequency may be 60 Hz or less, and the second image frequency may exceed 60 Hz.

Before the display device 10 is driven in the second driving mode, the display device 10 may be driven at least once in the sensing mode.

The timing controller 11 may provide to the data driver 12 grayscale values and control signals that are suitable for specifications of the data driver 12. Also, the timing controller 11 may provide to the first to third scan drivers 13*a*, 13*b*, and 13*c* a clock signal, a scan start signal, etc., that are suitable for specifications of the first to third scan drivers 13*a*, 13*b*, and 13*c*. Also, the timing controller 11 may provide to the emission driver 14, a clock signal, an emission stop signal, etc., that are suitable for specifications of the emission driver 14.

The data driver 12 may generate data voltages to be provided to data lines D1, D2, D3, . . . , and Dn, using the grayscale values and control signals, which are received from the timing controller 11. For example, the data driver 12 may sample grayscale values (e.g., gray values or gray level values), using a clock signal, and apply data voltages corresponding to the grayscale values to the data lines D1 to Dn in units of pixel rows. Here, n may be a natural number.

The first scan driver 13*a* may generate first scan signals to be provided to first scan lines GW1, GW2, GW3, . . . , and GWm by receiving the clock signal, the scan start signal, etc., from the timing controller 11. For example, the first scan driver 13*a* may be configured in the form of a shift register, and may generate the first scan signals in a manner that sequentially transfers the scan start signal having a turn-on level to a next stage circuit according to the clock signal (e.g., under the control of the clock signal).

In the first driving mode, the first scan driver 13*a* may sequentially provide the first scan signals having the turn-on level to the first scan lines GW1, GW2, GW3, . . . , and GWm. Therefore, the first scan signal having the turn-on level may be applied at least once to each first scan line GW1, GW2, GW3, . . . , and GWm in a first image frame period of the first driving mode. In some embodiments, the first scan signal having the turn-on level may be applied multiple times to each first scan line in the first image frame period of the first driving mode. Thus, an on-bias voltage can be provided to a driving transistor. Applying the on-bias voltage to the driving transistor may be effective in reducing a hysteresis of the driving transistor.

In the sensing mode, the first scan driver 13*a* may sequentially provide the first scan signals having the turn-on level to the first scan lines GW1, GW2, GW3, and GWm.

In the second driving mode, the first scan driver 13*a* may allow the first scan signals having a turn-off level to be maintained in the first scan lines GW1, GW2, GW3, . . . , and GWm. That is, in the second driving mode, the first scan signals may not include pulses having the turn-on level. For example, in the second driving mode, the timing controller 11 may not provide the scan start signal having the turn-on level to the first scan driver 13*a*.

The second scan driver 13*b* may generate second scan signals to be provided to second scan lines GI1, GI2, GI3, . . . , and GIm by receiving the clock signal, the scan start signal, etc., from the timing controller 11. For example, the second scan driver 13*b* may be configured in the form of a shift register.

In the first driving mode, the second scan driver 13*b* may sequentially provide the second scan signals having the turn-on level to the second scan lines GI1, GI2, GI3, . . . , and GIm. Therefore, the second scan signal having the turn-on level may be applied at least once to each second scan line in the first image frame period of the first driving mode. In some embodiments, the second scan signal having the turn-on level may be applied multiple times to each second scan line in the first image frame period of the first driving mode.

In the sensing mode, the second scan driver 13*b* may sequentially apply the second scan signals having the turn-on level at least twice to the second scan lines GI1, GI2, GI3, . . . , and GIm.

In the second driving mode, the second scan driver 13*b* may sequentially provide the second scan signals having the turn-on level to the second scan lines GI1, GI2, GI3, . . . , and GIm. The second scan signal having the turn-on level may be applied at least once to each second scan line in a second image frame period of the second driving mode.

The third scan driver 13*c* may generate third scan signals to be provided to third scan lines GB1, GB2, GB3, . . . , and GBm by receiving the clock signal, the scan start signal, etc., from the timing controller 11. For example, the third scan driver 13*c* may be configured in the form of a shift register.

In the first driving mode, the third scan driver 13*c* may sequentially provide the third scan signals having the turn-on level to the third scan lines GB1, GB2, GB3, . . . , and GBm. Therefore, the third scan signal having the turn-on level may be applied at least once to each third scan line in the first image frame period of the first driving mode. In some embodiments, the third scan signal having the turn-on level may be applied multiple times to each third scan line in the first image frame period of the first driving mode.

In the sensing mode, the third scan driver 13*c* may allow the third scan signals having the turn-off level to be maintained in the third scan lines GB1, GB2, GB3, . . . , and GBm. In another embodiment, the third scan signal having the turn-on level may be applied at least once to each third scan line in the second image frame period of the second driving mode.

In the second driving mode, the third scan driver 13*c* may maintain the third scan signals having the turn-off level in the third scan lines GB1, GB2, GB3, . . . , and GBm. The third scan signal having the turn-on level may be applied at least once to each third scan line in a second image frame period of the second driving mode.

As described above, an embodiment where the first to third scan drivers 13*a*, 13*b*, and 13*c* are separate from each other is described. However, in some embodiments, one scan driver in which the first to third scan drivers 13*a*, 13*b*, and 13*c* are integrated may be implemented. For example, only one of the first to third scan drivers 13*a*, 13*b*, and 13*c* may be implemented as the scan driver, and the first scan lines GW1, GW2, GW3, . . . , and GWm, the second scan lines GI1, GI2, GI3, . . . , and GIm, and the third scan lines GB1, GB2, GB3, . . . , and GBm may be connected to each other through switches. Therefore, when the switches are turned on/off, a suitable scan signal may be applied to a desired scan line.

The emission driver 14 may generate emission signals to be provided to emission lines E1, E2, E3, . . . , and Eo by receiving the clock signal, the emission stop signal, etc., from the timing controller 11. For example, the emission driver 14 may sequentially provide the emission signals having the turn-off level to the emission lines E1 to Eo. For example, the emission driver 14 may be configured in the form of a shift register, and may generate the emission signals in a manner that sequentially transfers the emission stop signal having the turn-off level to a next stage circuit under the control of the clock signal. Here, "o" may be a natural number.

The display unit 15 includes a plurality of pixels. Each pixel PXij may be connected to a corresponding data line, a corresponding scan line, a corresponding emission line, and a corresponding initialization voltage line. A configuration and driving method of the pixel PXij will be described in detail with reference to drawings from FIG. 2. Here, i and j may be natural numbers.

According to this embodiment, a number of data lines D1, D2, D3, . . . , and Dn connected to the display unit 15 may be equal to that of initialization voltage lines VI1, VI2, VI3, . . . , and Vin connected to the display unit 15. In some embodiments, the initialization voltage lines and the data lines may extend in the same direction. The data lines and the initialization voltage lines may be connected corresponding to pixel columns, respectively.

The initialization voltage lines VI1, VI2, VI3, . . . , and VIn may be connected to at least one of the initialization voltage supply unit 16, the voltage sensing unit 17, and the data lines D1, D2, D3, . . . , and Dn through switches SW1, SW2, SW3, . . . , SWn.

The initialization voltage supply unit 16 may supply an initialization voltage through an initialization common line VINT. A voltage level of the initialization voltage may be equal to or lower than that of a second power voltage which will be described below. Hereinafter, for convenience of descriptions, the voltage level of the initialization voltage is described as a low level.

The voltage sensing unit 17 may include at least one analog-to-digital converter ADC. The analog-to-digital converter ADC may be connected to a sensing line SL. The sensing line SL may be connected to each of the switches SW1, SW2, SW3, . . . , and SWn. The analog-to-digital converter ADC may convert a voltage input through the initialization voltage line into sensing information. When the voltage sensing unit 17 includes only one analog-to-digital converter ADC and one sensing line SL, voltage sensing may be time-divisionally performed in the sensing mode. In another embodiment, the voltage sensing unit 17 may include multiple analog-to-digital converters and sensing lines. For example, the number of analog-to digital converters and sensing lines may correspond to that of initialization voltage lines VI1, VI2, VI3, and VIn, so that the voltage sensing can be more rapidly performed (e.g., with one ADC and sensing line for each initialization voltage lines). The voltage sensing unit 17 may provide sensing information to the timing controller 11. In the second driving mode, the timing controller 11 may provide grayscale values, based on the sensing information.

Figure 2:
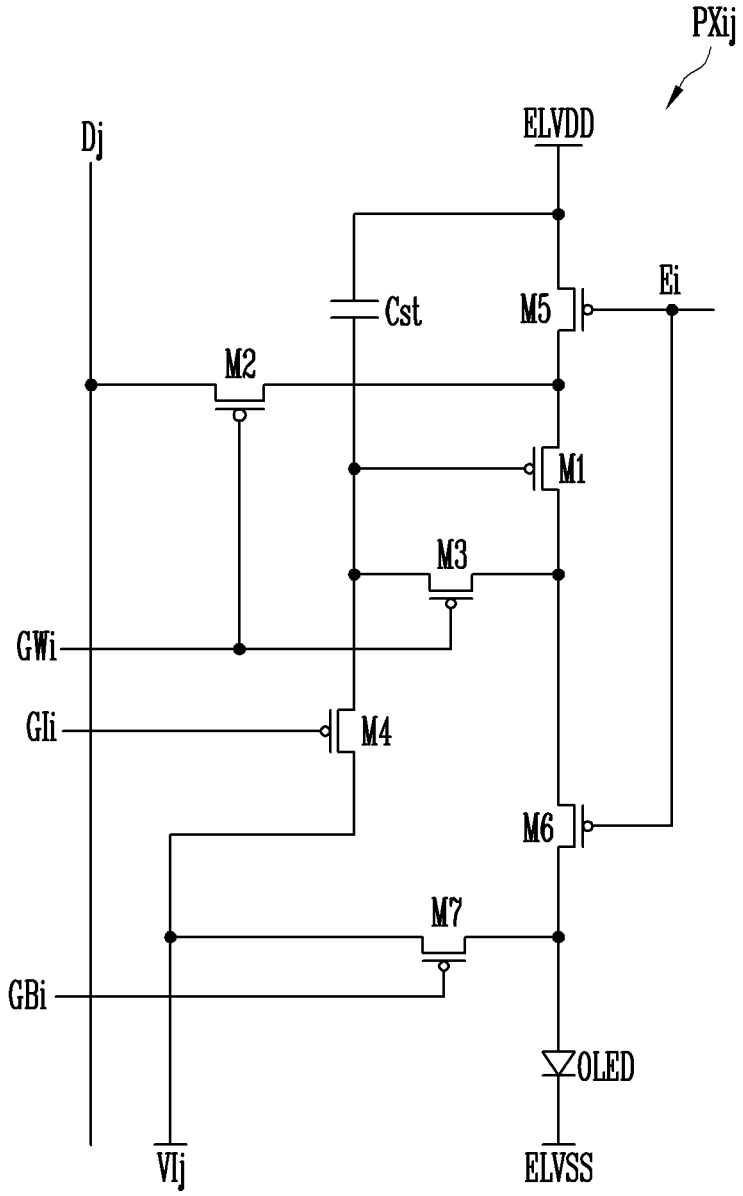
FIG. 2 is a diagram illustrating a pixel according to an embodiment of the present disclosure.

FIG. 2 is a diagram illustrating a pixel according to an embodiment of the present disclosure.

Referring to FIG. 2, the pixel PXij includes transistors M1 to M7, a storage capacitor, and an organic light emitting diode OLED.

A first transistor M1 may include one electrode (e.g., a first electrode), the other electrode (e.g., a second electrode), and a gate electrode. The first transistor M1 may be referred to as a driving transistor.

A second transistor M2 may include one electrode (e.g., a first electrode) connected to a data line Dj, the other electrode (e.g., a second electrode) connected to the one electrode of the first transistor M1, and a gate electrode connected to a first scan line GWi. The second transistor M2 may be referred to as a scan transistor or a switching transistor.

A third transistor M3 may include one electrode (e.g., a first electrode) connected to the other electrode of the first transistor M1, the other electrode (e.g., a second electrode) connected to the gate electrode of the first transistor M1, and a gate electrode connected to the first scan line GWi. In some embodiments, the third transistor M3 may include a plurality of sub-transistors connected in series to prevent a leakage current.

A fourth transistor M4 may include one electrode (e.g., a first electrode) connected to the gate electrode of the first transistor M1, the other electrode (e.g., a second electrode) connected to an initialization voltage line VIj, and a gate electrode connected to a second scan line GIi. In some embodiments, the fourth transistor M4 may include a plurality of sub-transistors connected in series to prevent a leakage current.

A fifth transistor M5 may include one electrode (e.g., a first electrode) connected to a first power voltage line ELVDD, the other electrode (e.g., a second electrode) connected to the one electrode of the first transistor M1, and a gate electrode connected to an emission line Ei.

A sixth transistor M6 may include one electrode (e.g., a first electrode) connected to the other electrode of the first transistor M1, the other electrode (e.g., a second electrode) connected to an anode electrode of the organic light emitting diode OLED, and a gate electrode connected to the emission line Ei.

A seventh transistor M7 may include one electrode (e.g., a first electrode) connected to the anode electrode of the organic light emitting diode OLED, the other electrode (e.g., a second electrode) connected to the initialization voltage line VIj, and a gate electrode connected to a third scan line GBi.

The storage capacitor Cst may include one electrode (e.g., a first electrode) connected to the gate electrode of the first transistor M1 and the other electrode (e.g., a second electrode) connected to the first power voltage line ELVDD.

The organic light emitting diode OLED may include the anode electrode connected to the one electrode of the seventh transistor M7 and a cathode electrode connected to a second power voltage line ELVSS.

In this embodiment, a case where the transistors M1 to M7 are implemented with a P-type transistor is described as an example. Therefore, based on a voltage, a turn-on level may be a low level, and a turn-off level may be a high level. Those skilled in the art may implement features of the present disclosure, using N-type transistors.

Figure 3:
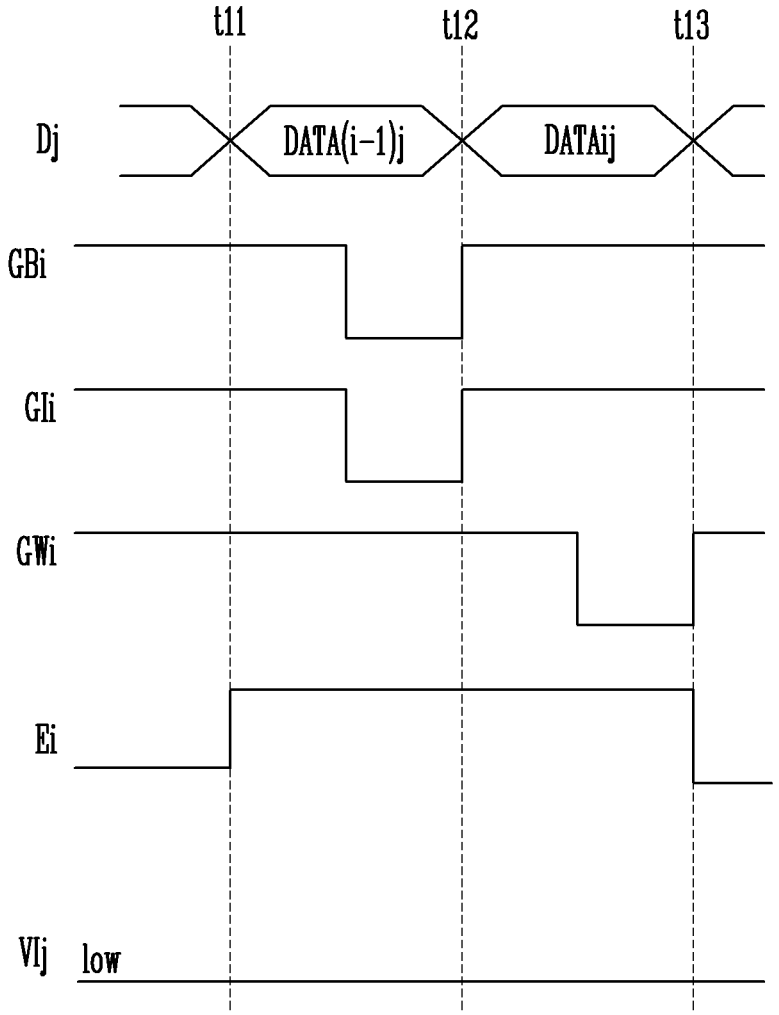
FIG. 3 is a diagram illustrating a first driving mode according to an embodiment of the present disclosure.

FIG. 3 is a diagram illustrating a first driving mode according to an embodiment of the present disclosure.

In the driving mode, the initialization voltage line VIj may be connected to the initialization voltage supply unit 16. That is, an initialization voltage may be maintained in the initialization voltage line VIj in each first image frame period. Also, data voltages DATA(i−1)j and DATAij corresponding to the data line Dj may be applied in each first image frame period.

During at least a portion of a period t11 to t12, the second scan signal having the turn-on level is supplied to the second scan line GIi, and the third scan signal having the turn-on level is supplied to the third scan line GBi. The period t11 to t12 may correspond to one horizontal period.

One first frame period may include a plurality of horizontal periods. During each of the plurality of horizontal periods, corresponding data voltage DATA(i−1)j or DATAij may be supplied to the data line Dj. Similarly, one second frame period may include a plurality of horizontal periods.

Thus, the transistors M4 and M7 are turned on, and the one electrode of the storage capacitor Cst and the anode electrode of the organic light emitting diode OLED are connected to the initialization voltage line Vij. Accordingly, the charge amount of the storage capacitor Cst and the charge amount of the organic light emitting diode OLED are initialized.

Next, during at least a portion of a period t12 to t13, the first scan signal having the turn-on level is supplied to the first scan line GWi, so that the transistors M2 and M3 are turned on. That is, the first scan signal having the turn-on level may be applied at least once to the first scan line GWi in each first image frame period of the first driving mode including a plurality of first image frames. The period t12 to t13 may correspond to one horizontal period.

The first transistor M1 is in a turned-on state due to the initialization voltage maintained in the one electrode of the storage capacitor Cst. Therefore, a data voltage DATAij applied to the data line Dj is applied to the one electrode of the storage capacitor Cst through the second transistor M2, the first transistor M1, and the third transistor M3. This state may be referred to as a diode connection state. The voltage applied to the one electrode of the storage capacitor Cst may be a voltage decreased by a threshold voltage of the first transistor M1 while passing through the first transistor M1. For example, the data voltage DATAij applied to the one electrode of the storage capacitor Cst may be reduced by the threshold voltage of the first transistor M1.

Next, the emission signal having the turn-on level is applied to the emission line Ei after a time t13, so that the transistors M5 and M6 are turned on. Accordingly, there may be formed a driving current path connecting the first power voltage line ELVDD, the fifth transistor M5, the first transistor M1, the sixth transistor M6, the organic light emitting diode OLED, and the second power voltage line ELVSS. A first power voltage applied to the first power voltage line ELVDD may have a voltage level larger than that of a second power voltage applied to the second power voltage line.

The amount of driving current flowing along the driving current path is adjusted by the voltage applied to the gate electrode of the first transistor M1. As described above, the voltage maintained in the one electrode of the storage capacitor included a threshold voltage decrement of the first transistor M1, and hence the amount of driving current is in a state in which it is compensated by the threshold voltage of the first transistor M1. For example, as described above, the voltage supplied to the one electrode of the storage capacitor may be reduced by the threshold voltage of the first transistor M1. Thus, the corresponding current flowing through the first transistor M1 is also reduced. This compensation method may be referred to as an internal compensation method.

According to the internal compensation method, the amount of driving current can be compensated by reflecting the state of the threshold voltage of the first transistor M1 (e.g., immediately reflecting the state of the threshold voltage), and no external circuit is additionally required.

However, when the image frequency (i.e., a number of image frames per second) at which an image frame is changed increases, the image frame period is correspondingly shortened, and therefore, compensation time may be insufficient.

Thus, the internal compensation method can be a compensation method suitable when the display device 10 is driven at an image frequency of, for example, 60 Hz or less.

Figure 4:
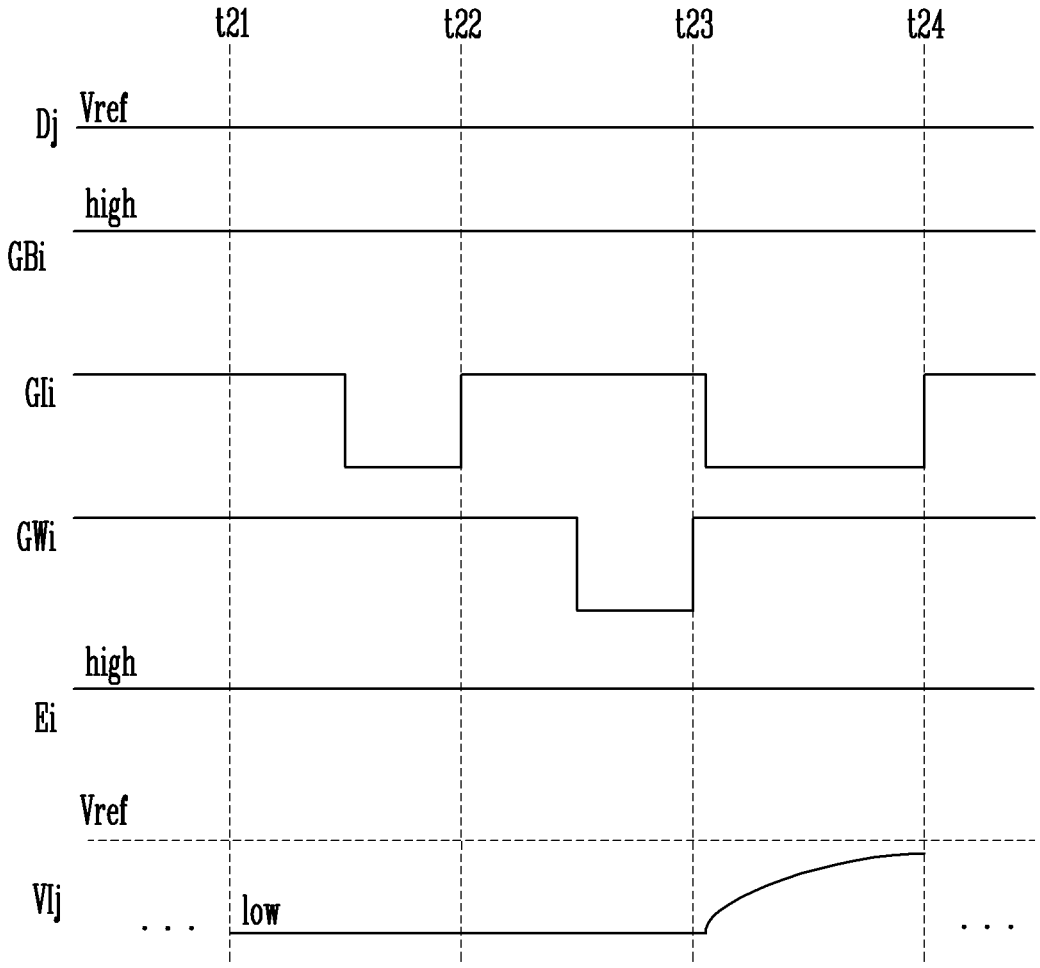
FIG. 4 is a diagram illustrating a sensing mode according to an embodiment of the present disclosure.

FIG. 4 is a diagram illustrating a sensing mode according to an embodiment of the present disclosure.

In the sensing mode, the third scan signal applied to the third scan line GBi may be maintained with the turn-off level (e.g., a high level). In addition, the emission signal applied to the emission line Ei may be maintained with the turn-off level (e.g., a high level). In addition, a reference voltage Vref may be applied to the data line Dj. The reference voltage Vref may have a constant voltage level. The reference voltage Vref may have a voltage level higher than that of the initialization voltage. For example, the difference in voltage level between the reference voltage Vref and the initialization voltage may be larger than an expected maximum threshold voltage of the first transistor M1.

During a first period in a period t21 to t22, the second scan signal having the turn-on level may be applied to the second scan line GIi. Thus, the fourth transistor M4 is turned on, and the one electrode of the storage capacitor Cst is connected to the initialization voltage line VIj, so that the charge amount of the storage capacitor Cst can be initialized. During at least a portion of the first period, the initialization voltage line VIj may be connected to the initialization voltage supply unit 16.

Next, during a second period in a period t22 to t23, the first scan signal having the turn-on level may be applied to the first scan line GWi. Therefore, the transistors M2 and M3 are turned on, and a current path is formed from the data line Dj to the one electrode of the storage capacitor Cst, including the transistor M1 that has already been in the turned-on state. Because the reference voltage Vref is applied to the data line Dj, a voltage to which a value obtained by subtracting the threshold voltage of the first transistor M1 from the reference voltage Vref may be applied to the one electrode of the storage capacitor Cst.

Next, during a third period in a period t23 to t24, the second scan signal having the turn-on level may be applied to the second scan line GIi. Therefore, the fourth transistor M4 is turned on, and the initialization voltage line VIj is connected to the one electrode of the storage capacitor Cst. During a portion of the third period, the initialization voltage line VIj may be connected to the voltage sensing unit 17. Therefore, the voltage level of the initialization voltage line VIj may be increased by that of the one electrode of the storage capacitor Cst. The voltage sensing unit 17 may generate sensing information by sensing a voltage level of the initialization voltage line VIj. For example, the analog-to-digital converter ADC of the voltage sensing unit 17 may convert an analog voltage input through the initialization voltage line VIj during a portion of the third period into digital sensing information.

In an embodiment, after a time t24, a scan signal having the turn-off level may be maintained in the first scan line GWi. After the time t24, when a scan signal having the turn-on level is applied to the first scan line GWi, a leakage current may occur through the fourth transistor M4 in voltage sensing of a next pixel row.

The sensing mode according to this embodiment may be performed when the display device 10 does not display any image. For example, the sensing mode may be performed in a state in which the display device 10 is powered off, a non-display state, an idle state, etc.

Figure 5:
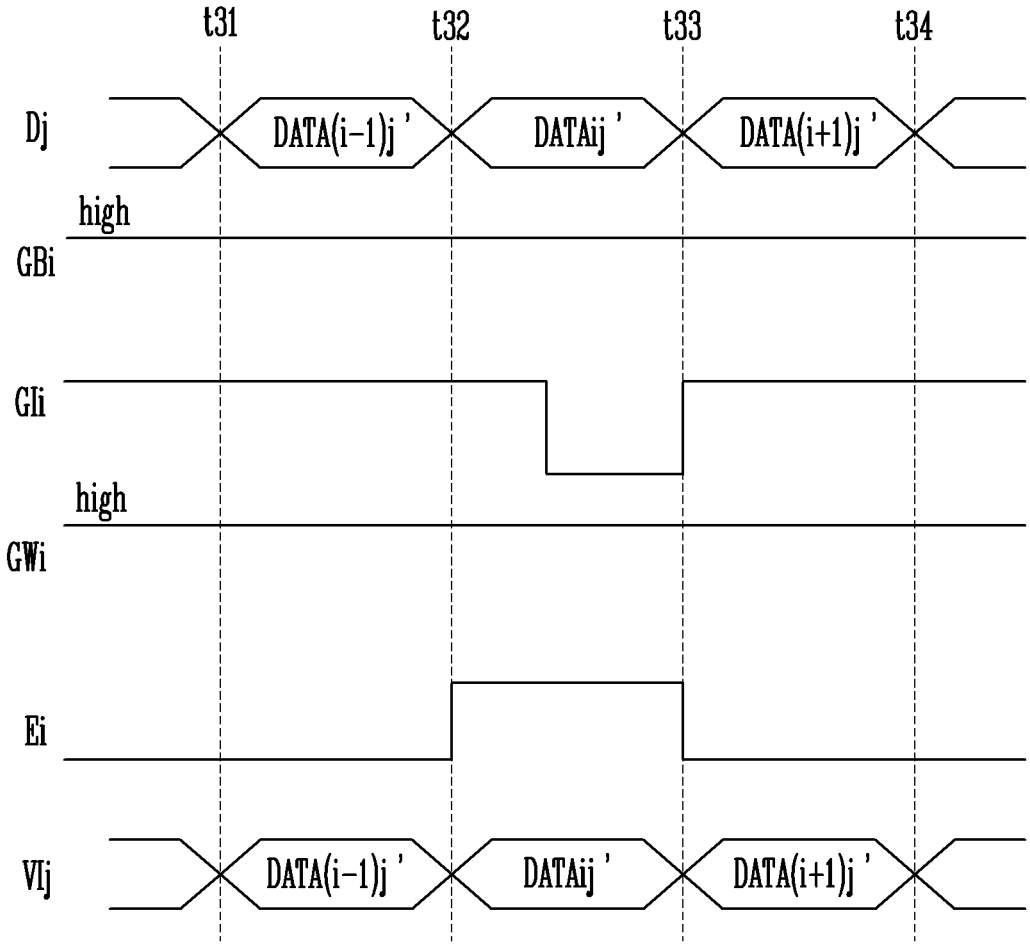
FIG. 5 is a diagram illustrating a second driving mode according to an embodiment of the present disclosure.

FIG. 5 is a diagram illustrating a second driving mode according to an embodiment of the present disclosure.

In the second driving mode, the timing controller 11 may provide the data driver 12 with grayscale values based on the sensing information provided in the sensing mode. Therefore, the data driver 12 may supply compensated data voltages DATA(i−1)j', DATAij', and DATA(i+1)j' to the data lines D1, D2, D3, . . . , and Dn.

In addition, a data voltage may be applied to the initialization voltage line VIj during at least a portion of each second image frame period. For example, the initialization voltage line VIj may be connected to the data line Dj through a switch, so that the data voltage is applied during at least a portion of the second image frame period.

In the second driving mode, the first scan signal having the turn-off level may be maintained in the first scan line GWi. That is, the first scan signal having the turn-off level may be maintained in the first scan line GWi in each second image frame period of the second driving mode including a plurality of second image frames. In the embodiment of FIG. 5, the third scan signal having the turn-off level may be maintained in the third scan line GBi.

During a period t32 to t33, a scan signal having the turn-on level may be applied to the second scan line GIi. Hence, the fourth transistor M4 may be turned on, and the initialization voltage line VIj may be connected to the one electrode of the storage capacitor Cst. Therefore, a data voltage DATAij' may be applied to the one electrode of the storage capacitor Cst. The period t32 to t33 may correspond to one horizontal period.

After a time t33, because the emission signal having the turn-on level is applied to the emission line Ei, there may be formed a driving current path connecting the first power voltage line ELVDD, the fifth transistor M5, the first transistor M1, the sixth transistor M6, the organic light emitting diode OLED, and the second power voltage line ELVSS, and the organic light emitting diode OLED may emit light, corresponding to an amount of driving current.

In the embodiment of FIG. 5, the compensated data voltages DATA(i−1)j', DATAij', and DATA(i+1)j' have already been applied using an external circuit, instead of internal compensation through diode connection (e.g., by supplying a threshold voltage to appropriate transistors). Therefore, the compensation method of FIG. 5 may be referred to as an external compensation method.

According to the external compensation method, any separate compensation time is not required during the second image frame period, and hence the external compensation method is a compensation method that is suitable when the image frequency is high. Thus, the external compensation method can be suitable when the display device 10 is driven at an image frequency exceeding 60 Hz.

Figure 6:
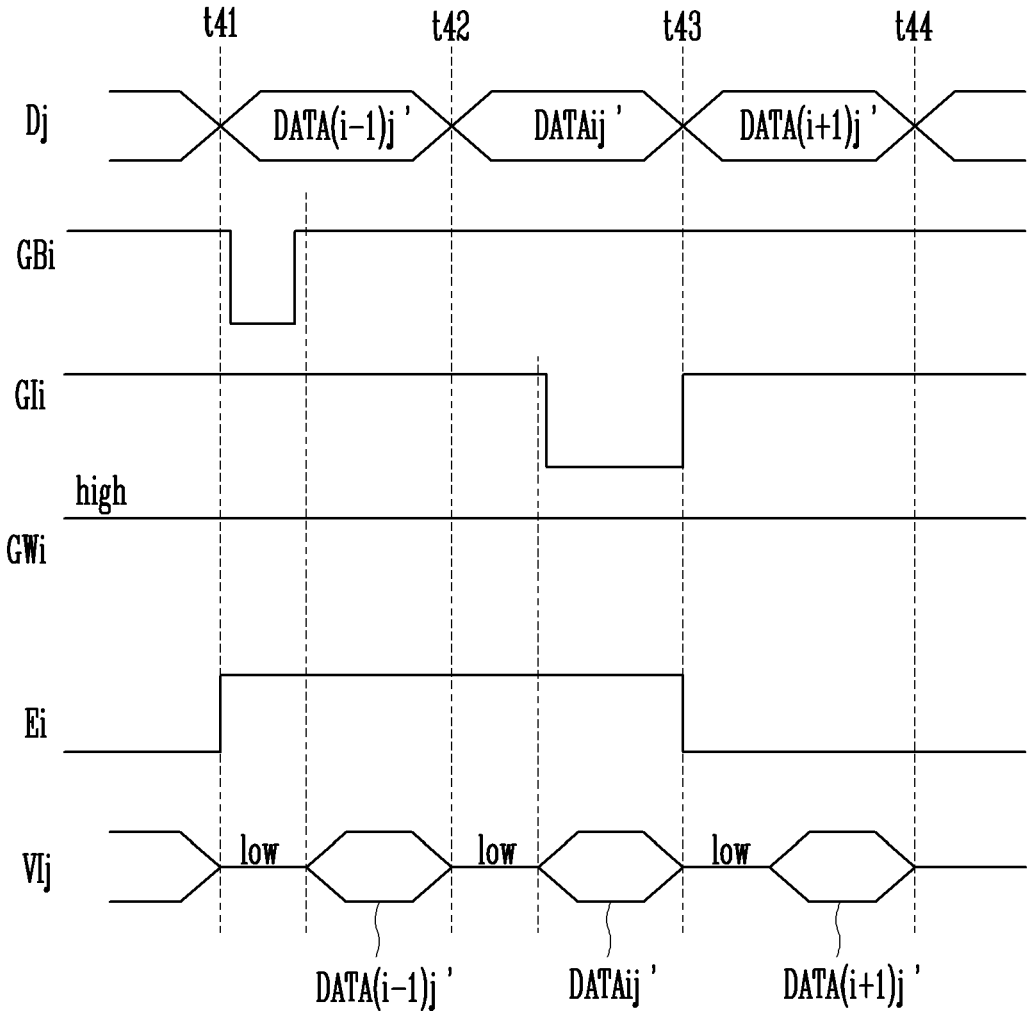
FIG. 6 is a diagram illustrating a second driving mode according to another embodiment of the present disclosure.

FIG. 6 is a diagram illustrating a second driving mode according to another embodiment of the present disclosure.

Hereinafter, differences between the embodiment of FIG. 5 and the embodiment of FIG. 6 will be mainly described, and overlapping descriptions may be omitted.

In the embodiment of FIG. 6, the initialization voltage may be applied to the initialization voltage line VIj during at least another portion of each second image frame period. For example, the initialization voltage may be applied to the initialization voltage line VIj during an initial period of a horizontal period t42 to t43, and the data voltage DATAij' may be applied to the initialization voltage line VIj during the other periods. This may be performed by connecting the initial voltage line VIj to the data line Dj or the initialization common line VINT through a switch.

In addition, the horizontal period t42 to t43 of the second image frame period in which the second scan signal having the turn-on level is applied to the second scan line GIi and a horizontal period t41 to t42 of the second image frame period in which the third scan signal having the turn-on level is applied to the third scan line GBi may be different from each other. Put differently, during the second image frame, the horizontal periods when the turn-on level is applied to the second scan line and the turn-on level is applied to the third scan line are different from each other.

According to the embodiment of FIG. 6, the organic light emitting diode OLED can be initialized when the second driving mode is performed.

Figure 7:
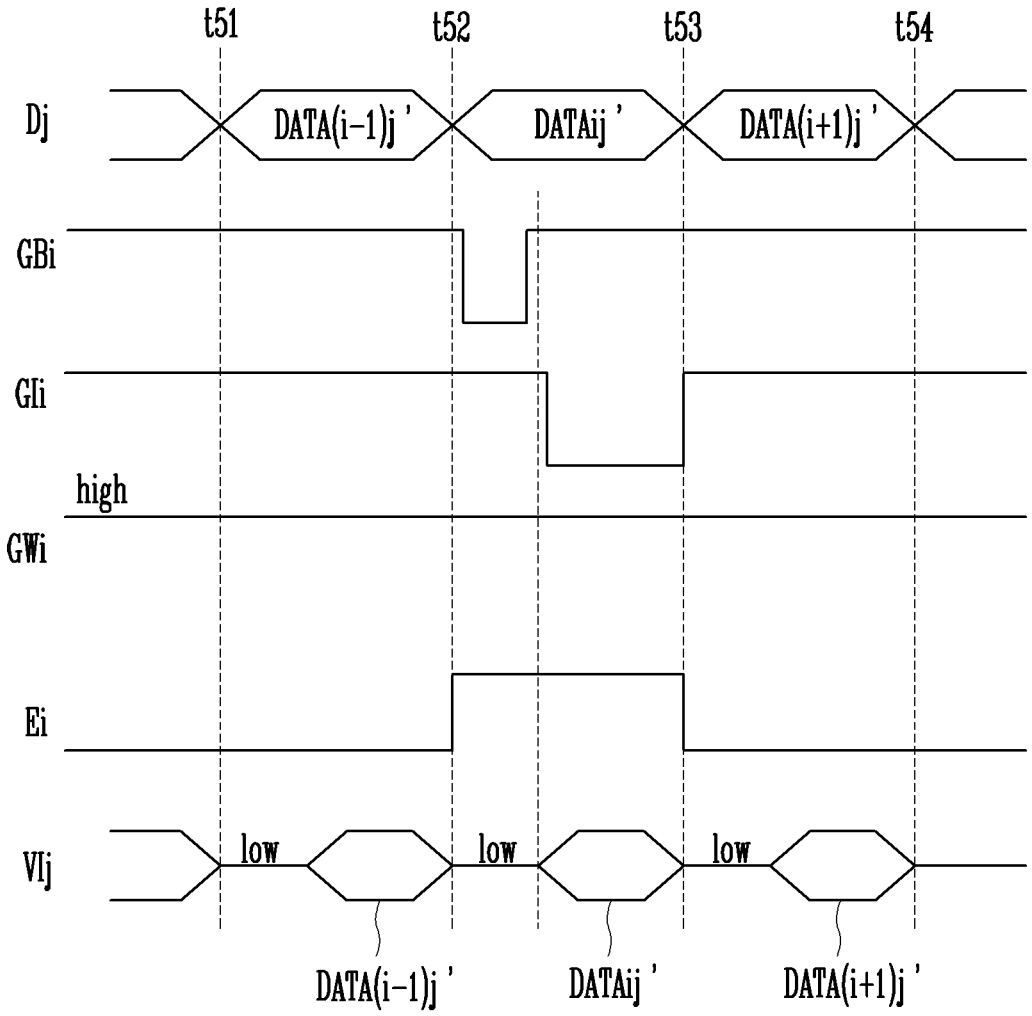
FIG. 7 is a diagram illustrating a second driving mode according to still another embodiment of the present disclosure.

FIG. 7 is a diagram illustrating a second driving mode according to still another embodiment of the present disclosure.

Hereinafter, differences between the embodiment of FIG. 6 and the embodiment of FIG. 7 will be mainly described, and overlapping descriptions may be omitted.

In the embodiment of FIG. 7, a horizontal period t52 to t53 of a second image frame period in which the second scan signal having the turn-on level is applied to the second scan line GIi and a horizontal period t52 to t53 of the second image frame period in which the third scan signal having the turn-on level is applied to the third scan line GBi may be the same (e.g., identical to each other). Put differently, during the second image frame, the horizontal periods when the turn-on level is applied to the second scan line and the turn-on level is applied to the third scan line are the same.

In the display device according to the present disclosure, a compensation method of the driving transistor can be changed depending on an image frequency.

Example embodiments have been disclosed herein, and although specific terms are employed, they are used and are to be interpreted in a generic and descriptive sense only and not for the purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of ordinary skill in the art that various changes in form and details may be made without departing from the spirit and scope of the present disclosure as set forth in the following claims and their equivalents.

What is claimed is:

1. A display device comprising a plurality of pixels, wherein each pixel comprises:

a first transistor comprising a first electrode, a second electrode, and a gate electrode;

a second transistor comprising a first electrode connected to a data line, a second electrode connected to the first electrode of the first transistor, and a gate electrode connected to a first scan line;

a third transistor comprising a first electrode connected to the second electrode of the first transistor, a second electrode connected to the gate electrode of the first transistor, and a gate electrode connected to the first scan line; and a fourth transistor comprising a first electrode connected to the gate electrode of the first transistor, a second electrode connected to an initialization voltage line, and a gate electrode connected to a second scan line, wherein a first scan signal having a turn-on level is applied at least once to the first scan line in each first image frame period of a first driving mode including a plurality of first image frames, and wherein the first scan signal having a turn-off level is maintained in the first scan line, and a scan signal having a turn-on level is applied to another scan line, in each second image frame period of a second driving mode including a plurality of second image frames.

2. The display device of claim 1, wherein, in the first image frame period, an initialization voltage is maintained in the initialization voltage line, and a data voltage is applied to the data line, and wherein the data voltage is applied to the initialization voltage line during at least a portion of the second image frame period.

3. The display device of claim 1, wherein the initialization voltage line and the data line extend in the same direction.

4. The display device of claim 1, wherein a number of data lines connected to the plurality of pixels and a number of initialization voltage lines connected to the plurality of pixels are equal to each other.

5. A display device comprising a plurality of pixels, wherein each pixel comprises:

a first transistor comprising a first electrode, a second electrode, and a gate electrode;

a second transistor comprising a first electrode connected to a data line, a second electrode connected to the first electrode of the first transistor, and a gate electrode connected to a first scan line;

a third transistor comprising a first electrode connected to the second electrode of the first transistor, a second electrode connected to the gate electrode of the first transistor, and a gate electrode connected to the first scan line; and a fourth transistor comprising a first electrode connected to the gate electrode of the first transistor, a second electrode connected to an initialization voltage line, and a gate electrode connected to a second scan line, wherein a first scan signal having a turn-on level is applied at least once to the first scan line in each first image frame period of a first driving mode including a plurality of first image frames, wherein the first scan signal having a turn-off level is maintained in the first scan line in each second image frame period of a second driving mode including a plurality of second image frames, wherein, in the first image frame period, an initialization voltage is maintained in the initialization voltage line, and a data voltage is applied to the data line, wherein the data voltage is applied to the initialization voltage line during at least a portion of the second image frame period, and wherein, in a sensing mode, a reference voltage is applied to the data line, a second scan signal having the turn-on level is applied to the second scan line during a first period, the first scan signal having the turn-on level is applied to the first scan line during a second period after the first period, and the second scan signal having the turn-on level is applied to the second scan line during a third period after the second period.

6. The display device of claim 5, further comprising:

an initialization voltage supply unit configured to supply the initialization voltage; and a voltage sensing unit, wherein, in the sensing mode, the initialization voltage line is connected to the initialization voltage supply unit during at least a portion of the first period, and is connected to the voltage sensing unit during at least a portion of the third period.

7. The display device of claim 6, wherein the voltage sensing unit comprises at least one analog-to-digital converter, wherein the analog-to-digital converter is configured to convert a voltage input through the initialization voltage line during at least a portion of the third period into sensing information.

8. The display device of claim 7, further comprising:

a timing controller configured to provide a grayscale value; and a data driver configured to generate the data voltage corresponding to the grayscale value and supply the data voltage to the data line, wherein the voltage sensing unit is configured to provide the sensing information to the timing controller, and wherein, in the second driving mode, the timing controller is configured to provide the grayscale value, based on the sensing information.

9. The display device of claim 5, wherein each pixel further comprises:

a fifth transistor comprising a first electrode connected to a first power voltage line, a second electrode connected to the first electrode of the first transistor, and a gate electrode connected to an emission line;

a sixth transistor comprising a first electrode connected to the second electrode of the first transistor and a gate electrode connected to the emission line;

a seventh transistor comprising a first electrode connected to a second electrode of the sixth transistor, a second electrode connected to the initialization voltage line, and a gate electrode connected to a third scan line;

a storage capacitor comprising a first electrode connected to the gate electrode of the first transistor and a second electrode connected to the first power voltage line; and an organic light emitting diode comprising an anode electrode connected to the first electrode of the seventh transistor and a cathode electrode connected to a second power voltage line.

10. The display device of claim 9, wherein, in the sensing mode, a third scan signal having the turn-off level is maintained in the third scan line, and an emission signal having the turn-off level is maintained in the emission line.

11. The display device of claim 9, wherein, in the second driving mode, a third scan signal having the turn-off level is maintained in the third scan line.

12. The display device of claim 9, wherein the initialization voltage is applied to the initialization voltage line during at least another portion of the second image frame period.

13. The display device of claim 12, wherein during one of the second image frames, horizontal periods when the turn-on level is applied to the second scan line and the turn-on level is applied to the third scan line are different from each other.

14. The display device of claim 12, wherein during one of the second image frames, horizontal periods when the turn-on level is applied to the second scan line and the turn-on level is applied to the third scan line are the same.

15. A display device comprising a plurality of pixels, wherein each pixel comprises:

a first transistor comprising a first electrode, a second electrode, and a gate electrode;

a second transistor comprising a first electrode connected to a data line, a second electrode connected to the first electrode of the first transistor, and a gate electrode connected to a first scan line;

a third transistor comprising a first electrode connected to the second electrode of the first transistor, a second electrode connected to the gate electrode of the first transistor, and a gate electrode connected to the first scan line; and a fourth transistor comprising a first electrode connected to the gate electrode of the first transistor, a second electrode connected to an initialization voltage line, and a gate electrode connected to a second scan line, wherein a first scan signal having a turn-on level is applied at least once to the first scan line in each first image frame period of a first driving mode including a plurality of first image frames, wherein the first scan signal having a turn-off level is maintained in the first scan line in each second image frame period of a second driving mode including a plurality of second image frames, and wherein a first image frequency at which the plurality of first image frames are changed in the first driving mode is lower than a second image frequency at which the plurality of second image frames are changed in the second driving mode.

16. The display device of claim 15, wherein the first image frequency is 60 Hz or less, and the second image frequency exceeds 60 Hz.

* * * * *